US011835251B2

(12) United States Patent
Mehta et al.

(10) Patent No.: US 11,835,251 B2
(45) Date of Patent: Dec. 5, 2023

(54) METHOD AND A SYSTEM FOR OPERATING AN AIR HANDLING UNIT AT EFFECTIVE STATIC PRESSURE

(71) Applicant: Carrier Corporation, Palm Beach Gardens, FL (US)

(72) Inventors: Rohan Ajinkya Mehta, Telangana (IN); Pratap Kumar DVS, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 63 days.

(21) Appl. No.: 17/534,755

(22) Filed: Nov. 24, 2021

(65) Prior Publication Data

US 2022/0178578 A1 Jun. 9, 2022

(30) Foreign Application Priority Data

Dec. 4, 2020 (IN) ..... 202011052896

(51) Int. Cl.

| | |
|---|---|
| ***F24F 11/77*** | (2018.01) |
| ***F24F 11/64*** | (2018.01) |
| ***F24F 11/46*** | (2018.01) |
| *F24F 140/40* | (2018.01) |
| *F24F 140/50* | (2018.01) |
| *F24F 110/30* | (2018.01) |
| *F24F 110/40* | (2018.01) |

(52) U.S. Cl.

CPC ..... *F24F 11/77* (2018.01); *F24F 11/46* (2018.01); *F24F 11/64* (2018.01); *F24F 2110/30* (2018.01); *F24F 2110/40* (2018.01); *F24F 2140/40* (2018.01); *F24F 2140/50* (2018.01)

(58) Field of Classification Search

CPC ..... F24F 11/77

See application file for complete search history.

(56) References Cited

U.S. PATENT DOCUMENTS

| | | | | |
|---|---|---|---|---|
| 5,863,246 | A | 1/1999 | Bujak, Jr. | |
| 6,116,095 | A * | 9/2000 | Radle | B60H 1/00364 73/756 |
| 2006/0116067 | A1 | 6/2006 | Federspiel | |
| 2008/0161976 | A1* | 7/2008 | Stanimirovic | F24F 11/30 454/239 |
| 2019/0236446 | A1* | 8/2019 | Qin | G06N 3/044 |
| 2022/0058497 | A1* | 2/2022 | Vazquez-Canteli | G05B 15/02 |

FOREIGN PATENT DOCUMENTS

| | | | |
|---|---|---|---|
| JP | 2018173206 | A | 11/2018 |

OTHER PUBLICATIONS

European Search Report for Application No. 21212494.5, dated Apr. 19, 2022; 8 Pages.

* cited by examiner

*Primary Examiner* — Nathan L Laughlin

(74) *Attorney, Agent, or Firm* — CANTOR COLBURN LLP

(57) ABSTRACT

A system and a method for operating an air handling unit (AHU) at an effective static pressure setpoint in a HVAC system. The method includes receiving airflow setpoint values from each of a plurality of variable air volume (VAV) units to determine a combined airflow set point for the plurality of VAV units of an air handling unit (AHU). The method also includes determining an effective static pressure setpoint for the AHU based on a relation between the combined airflow setpoint value and a static pressure represented by a system effect curve.

17 Claims, 5 Drawing Sheets

METHOD AND A SYSTEM FOR OPERATING AN AIR HANDLING UNIT AT EFFECTIVE STATIC PRESSURE

FOREIGN PRIORITY

This application claims priority to Indian Patent Application No. 202011052896, filed Dec. 4, 2020, and all the benefits accruing therefrom under 35 U.S.C. § 119, the contents of which in its entirety are herein incorporated by reference.

TECHNICAL FIELD

The present invention generally relates to heating, ventilation, and air conditioning (referred hereinafter as "HVAC") system. More particularly, the invention relates to a system and a method for operating an air handling unit (AHU) at an effective static pressure setpoint.

BACKGROUND

Heating, ventilation, and air conditioning (HVAC) system is used in residential/commercial places for cooling or heating a building. In order to maintain cooling or heating in the building, the HVAC system uses an air handling unit (AHU) and one or more variable air volume (referred hereinafter as "VAV") units. Each of the VAV units may use diffusers to serve different zones/areas of the building. Particularly, each zone of the building may have a few diffusers connected with a VAV unit for maintaining a desired temperature in that zone. This helps in maintaining different cooling or heating temperatures at the same time in various zones of the building.

To ensure efficient and effective functioning of the AHU and the VAV unit, it becomes critical to draft a functional curve so that a deviation from an ideal curve can be seen. Such deviation can help to provide a benchmark and also provides information on whether an installation of the AHU, the VAV units etc. in the HVAC system is done properly or not. Currently, there is no mechanism to gauge the functional curve at an installation site and determine losses that might have occurred affecting the overall functioning of the AHU and the VAV units. Further, in order to determine cause for the losses in the AHU, the VAV units etc., a technician has to physically check each and every part of the entire HVAC system; but still the technician may not be able to detect all defects causing such losses. In addition, such a process is a time-consuming and labor-intensive task.

In order to meet the end requirements of cooling and heating in the building, static pressure setpoint in the AHU needs to be maintained by controlling fan speed of the AHU. Further, for controlling the fan speed of the AHU, static pressure setpoint of the AHU is kept at a constant value which operates in a system resistance curve i.e. static pressure/cubic feet per minute (cfm) when the speed of the fan varies. Alternatively, the static pressure of the AHU can be reset using a trim & respond method which operates by monitoring a maximum value of a damper position of all VAV units & for higher position value, the static pressure setpoint is increased & vice versa clamping to a higher or a lower limit which are manually calculated/approximated. However, the trim & respond method is inefficient due to randomly changing static pressure which may not follow a system impedance curve. Also, dampers of the VAV units are in an intermediate position which adds impedance in an airflow casing system curve to deflect inwards, thereby resulting in more losses. In order to determine the AHU static pressure setpoint, a balancer requires a lot of time and does all the work manually to define the static pressure setpoint. Further, any HVAC system is designed based on the requirements at the location where the system is installed. But the actual installation requires several changes and adjustments in piping/ductwork of the HVAC. Accordingly, the designed HVAC systems seldom work ideally as planned.

In view of the afore-mentioned problems, there is a need of an efficient and effective system and a method for determining a static pressure setpoint of an AHU. There is also a requirement to reduce the time taken by a balancer for manually determining the static pressure setpoint of the AHU. In order to solve the problems in the existing solutions, a system and a method are disclosed.

SUMMARY

Various embodiments of the invention describe a method for operating an air handling unit (AHU) at an effective static pressure setpoint. The method comprises the steps of receiving airflow setpoint values from each of a plurality of variable air volume (VAV) units to determine a combined airflow set point for the plurality of VAV units of an air handling unit (AHU). The method also comprises the steps of determining an effective static pressure setpoint for the AHU based on a relation between the combined airflow setpoint value and a static pressure represented by a system effect curve. The method further comprises the steps of operating the AHU at the effective static pressure setpoint.

In an embodiment of the invention, a damper position of each VAV unit is monitored for determining a starving VAV unit from the plurality of VAV units and computing the effective static pressure setpoint of the AHU.

In a different embodiment of the invention, the method further comprises the steps of determining an offset for the starving VAV unit and adjusting the offset to the effective static pressure setpoint of the AHU for the starving VAV unit.

In an embodiment of the invention, the adjustment of the offset to the effective static pressure setpoint of the AHU is achieved by either increasing or decreasing the effective static pressure setpoint of the AHU.

In another embodiment of the invention, the method further comprises the steps of automatically monitoring and learning an effect of the adjustment of the offset to the effective static pressure setpoint of the AHU for efficient operation of each of the plurality of VAV units.

In yet another embodiment of the invention, the method further comprises the steps of determining a second starving VAV unit and a second offset based on the effect of the adjustment of the offset to the effective static pressure setpoint of the AHU.

In another embodiment of the invention, the airflow setpoint values of each of the plurality of VAV units is determined based on load requirement, a value of maximum allowed airflow setpoint & a value of minimum allowed airflow setpoint.

In a different embodiment of the invention, the effective static pressure setpoint is obtained by varying the speed of a fan to meet the demand of the effective static pressure setpoint.

In yet another embodiment of the invention, the fan operates in accordance with the system effect curve to follow a least impedance airflow path.

In a different embodiment of the invention, the AHU is connected with each of the VAV units through one or more ducts.

In an embodiment of the invention, the method further comprises steps of monitoring an existing static pressure control strategy instantaneous value at a defined interval time along with a recorded data to compare it with an impedance curve.

In another embodiment of the invention, the method further comprises steps of equating and showing energy losses to a user due to not following the impedance curve.

Various embodiments of the invention describe a system for operating an air handling unit (AHU) at an effective static pressure setpoint. The system comprises a plurality of variable air volume (VAV) units and an air handling unit (AHU) comprising a controller. Each of the VAV units is configured to determine and communicate airflow setpoint values. The controller is configured to receive the airflow setpoint values from each of the VAV units. The controller determines a combined airflow set point for the plurality of VAV units of the AHU. The controller is also configured to determine an effective static pressure setpoint based on a relation between the combined airflow setpoint value and a static pressure represented by a system effect curve and operate the AHU at the effective static pressure setpoint.

In a different embodiment of the invention, the controller is further configured to monitor a damper position of each VAV unit for determining a starving VAV unit from the plurality of VAV units and compute the effective static pressure setpoint of the AHU.

In yet another embodiment of the invention, the controller is further configured to determine an offset for the starving VAV unit and adjust the offset to the effective static pressure setpoint of the AHU for the starving VAV unit.

In an embodiment of the invention, the adjustment of the offset to the effective static pressure setpoint of the AHU is achieved by either increasing or decreasing the effective static pressure setpoint of the AHU.

In yet another embodiment of the invention, the controller is further configured to automatically monitor and learn an effect of the adjustment of the offset to the effective static pressure setpoint of the AHU for efficient operation of each of the plurality of VAV units.

In another embodiment of the invention, the controller is further configured to determine a second starving VAV unit and a second offset based on the effect of the adjustment of the offset to the effective static pressure setpoint of the AHU.

In yet another embodiment of the invention, the effective static pressure setpoint is obtained by varying the speed of a fan to meet the demand of the effective static pressure setpoint.

In another different embodiment of the invention, the fan operates in accordance with the system effect curve to follow a least impedance airflow path.

In an embodiment of the invention, the AHU is connected with each of the VAV units through one or more ducts.

In another different embodiment of the invention, the airflow setpoint values of each of the plurality of VAV units is determined based on load requirement, a value of maximum allowed airflow setpoint and a value of minimum allowed airflow setpoint.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION

Figure 1:
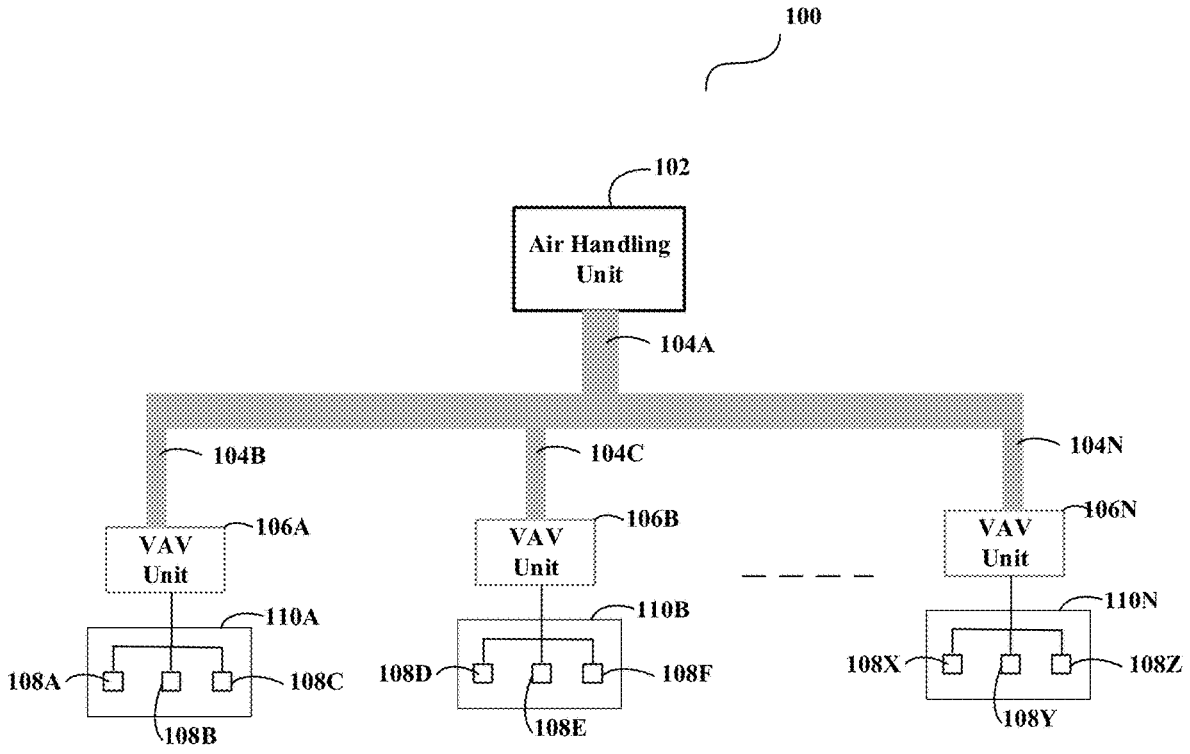
FIG. 1 depicts an exemplary system architecture according to an exemplary embodiment of the invention.

Described herein is the technology with a system and a method for determining and operating an air handling unit (AHU) at an effective static pressure setpoint. Such AHU is connected to a plurality of variable air volume (referred hereinafter as VAV) units through one or more ducts in a HVAC system. The AHU of the HVAC system may be positioned on a roof or outside of a building or inside the building near any serving area. The AHU may be connected to one or more supply ducts and the one or more supply ducts may further be connected to the plurality of VAV units placed inside the building. The AHU may also be connected to one or more return ducts for drawing the air from inside the building and either releasing it back to the environment or partially mixing it with fresh air in the supply air duct. When the air from the AHU reaches the plurality of VAV units, the plurality of VAV units may use one or more diffusers to provide the air in different zones of the building. Each of the VAV units may be responsible for maintaining a desired temperature in each zone.

Moreover, each of the plurality of VAV units may comprise an airflow sensor for measuring airflow of the VAV units. Similarly, the AHU may also comprise an airflow sensor for measuring airflow within the AHU unit. The airflow sensor of each VAV unit may sense and communicate airflow setpoint values to a controller of the AHU for determining a combined airflow set point for the plurality of VAV units of the AHU. Upon receiving the airflow setpoint values from the airflow sensor of each VAV unit, the controller may determine an effective static pressure setpoint for the AHU based on a relation between the combined airflow setpoint value and a static pressure represented by a system effect curve. Accordingly, the AHU may be operated at the effective static pressure setpoint as determined.

Throughout the specification, reference numeral 104 depicts all ducts. The reference numerals 104A-104D (104) may be considered as a separate duct in a HVAC system. Also, throughout the specification, reference numeral 106 depicts all VAV units. The reference numerals 106A-106N (106) may be considered as a separate VAV unit in the HVAC system. Similarly, throughout the specification, reference numeral 108 depicts all diffusers. Each of the reference numerals 108A-108Z may be considered as a separate diffuser. Lastly, throughout the specification, reference numeral 110 depicts all zones. Each of the reference numerals 110A-110N may be considered as a separate zone.

FIG. 1 depicts an exemplary system architecture 100 according to an exemplary embodiment of the invention. As depicted in FIG. 1, an air handling unit (AHU) 102 may be connected with a plurality of variable air volume (VAV) units 106A-106N through one or more ducts 104. A first duct 104A may supply air (fresh or conditioned air) to a second duct 104B, a third duct 104C and a fourth duct 104D. As depicted in FIG. 1, the second duct 104B may supply the air to a first VAV unit 106A, the third duct 104C may supply the air to a second VAV unit 106B and the fourth duct 104N may supply the air to a third VAV unit 106N. Although, only three VAV units are shown in FIG. 1; however, any "n" number of VAV units may be connected to the AHU 102.

When the air flowing through the ducts 104A-104D reaches the first VAV unit 106A, the first VAV unit 106A may supply the air in a first zone 110A through one or more diffusers 108A, 108B and 108C. Similarly, the second VAV unit 106B may supply the air in a second zone 110B through one or more diffusers 108D, 108E and 108F. Moreover, the third VAV unit 106N may supply the air in a third zone 110N through one or more diffusers 108X, 108Y, and 108Z. Each of the VAV units 106 may maintain different temperature in each zone based on a temperature either desired by occupants in that particular zone or set by a user. In addition, the air present in each zone 110 may be returned/circulated back to the AHU 102 through one or more return ducts (not shown) connected to the VAV units 106 and to the AHU 102.

When the AHU 102 and the plurality of VAV units 106A-106N gets operational after the completion of the installation and commissioning work, a functional curve may be acquired for operating parameters (such as fan speed, duct static pressure setpoint, sum of airflow value of all VAVs units served by same AHU etc.) of the AHU 102, airflow setpoint of the plurality of VAV units 106A-106N etc. Such a functional curve may be compared with an ideal curve to determine deviations of the functional curve from the ideal curve. As used herein, the functional curve may be a curve obtained based on actual operation and functioning of the AHU 102 and the plurality of VAV units 106A-106N. As used herein, the ideal curve may be a curve obtained based on an expected functioning and operation of the AHU 102 which is provided by a manufacturer of the AHU.

Further, each of the plurality of VAV units 106A-106N may determine or equate airflow setpoints value based on a percentage of heating/cooling load requirement, a value of a minimum airflow setpoint and a value of a maximum airflow setpoint. The airflow sensor of each VAV unit 106 may also communicate the determined/equated airflow setpoints value to a controller of the AHU 102. For an instance, an airflow sensor of the first VAV unit 106A senses 100 cubic feet per minute (cfm), an airflow sensor of the second VAV unit 106B senses 1000 cfm, and an airflow sensor of the third VAV unit 106N senses 2000 cfm. Once the controller receives the airflow setpoints value from each of the VAV unit 106, the controller may determine a combined airflow set point for the plurality of VAV units. In an embodiment, the controller may determine the combined airflow set point by using following formula:

Combined airflow set point=Airflow setpoint value of VAV unit 106*A*+Airflow setpoint value of VAV unit 106*B* . . . +Airflow setpoint value of VAV unit 106*N*

For an instance, the controller determines the combined airflow set point as 3100 cfm (i.e. 100+1000+2000 cfm from each VAV unit 106) using above equation. The controller may further determine an effective static pressure setpoint for the AHU 102 based on a relation between the combined airflow setpoint value (i.e. 3100 cfm) and a static pressure represented by a system effect curve. In addition, an AHU impedance curve defining a static pressure to an airflow relation is also taken into consideration for determining an effective static pressure setpoint for the AHU 102. Accordingly, the controller of the AHU 102 may automatically operate the AHU 102 at the determined effective static pressure setpoint. In an exemplary embodiment, the effective static pressure setpoint is obtained by varying the speed of a fan of the AHU 102 to meet the demand of the effective static pressure setpoint. Further, the fan of the AHU 102 operates in accordance with the system effect curve to follow a least impedance airflow path. Herein, the impedance path refers to a path followed by the air from the AHU 102 to each VAV unit 106 through the ducts 104 having with joint, bents. Such impedance is caused in the airflow path due to the joint, bents in ducts, connections to the VAV units from the ducts 104 etc. As used herein, the term "static pressure setpoint" may refer to a setpoint value settable in the controller of the air handling unit 102. It is used to control AHU supply fan speed to achieve AHU supply duct at a mention static pressure.

Moreover, the controller of the AHU 102 may also monitor damper position of each VAV unit 106 individually. Such monitoring of the damper position of each VAV unit 106 by the controller is determined using actuators present in each VAV unit 106. Further, the damper position of each VAV unit 106 is monitored periodically after a pre-determined period of time. Such pre-determined period of time may be set by a technician or an air balancer of the AHU 102. Based on automatic monitoring of the damper position of each VAV unit 106, the controller may determine a starving VAV unit from the plurality of VAV units. In an exemplary embodiment, the starving VAV unit may be a VAV unit which is operating with less airflow setpoint value as compared to actual required airflow setpoint value for its effective functioning thereby, resulting in ineffective operation of the AHU 102 and the VAV units 106. Therefore, the starving VAV unit may be determined by comparing a pre-defined or ideal airflow setpoint value with an airflow setpoint value and static pressure setpoint at which the starving VAV is currently operating. For an example, the first VAV unit 106A can be considered as a starving unit herein as the first VAV unit 106A is currently operating at an airflow setpoint value of 100 cubic feet per minute (cfm) which is less than the pre-defined or ideal airflow setpoint value (say, 850 cfm). In an exemplary embodiment, a starving VAV situation can be determined if maximum of damper position of all VAV units 106 is greater than 95% open than that VAV can be marked as a starving VAV unit or approaching a starving state. In case the starvation gets over offset situation due to change in load, which will be identified when maximum of all VAV damper position is less than 85% (user adjustable) for more than 4 minutes (user adjustable).

After the starving VAV unit 106A is determined, the controller of the AHU 102 may determine an offset for the starving VAV unit. In an exemplary embodiment, a user adjustable static pressure setpoint offset value (say, for example: 0.02 inwc (inches of water)) can be added to the effective static pressure setpoint in the AHU 102 (equated from the curve). Such adjusted offset will be monitored for a user adjustable period of time (for an example: 4 minutes). If still a starving VAV is found, then same value (0.02 inwc) of the offset is further added till no starving is found. Similarly, exact opposite i.e. offset removal will happen if an over-offset situation is found. It is be noted here that in no circumstance the total static pressure offset value will go in negative. The determined offset may be adjusted by the controller of the AHU 102 to the effective static pressure setpoint of the AHU 102 for the starving VAV unit 106A. In other words, the adjustment of the offset to the effective static pressure setpoint of the AHU 102 is achieved by either increasing or decreasing the effective static pressure setpoint of the AHU 102.

After some time (say after 1 hour), the controller of the AHU 102 may receive an updated airflow setpoint values from each VAV units 106. Consider another instance, the airflow sensor of the first VAV unit 106A senses 1100 cfm, the airflow sensor of the second VAV unit 106B senses 2000 cfm, and the airflow sensor of the third VAV unit 106N senses 50 cfm. On receiving the updated airflow setpoint values, the controller may determine a second starving VAV unit i.e. 106N and accordingly determine a second offset. Accordingly, the controller may again adjust the second offset to the effective static pressure setpoint of the AHU. On adjusting the offset to the effective static pressure setpoint of the AHU 102, the controller may again automatically and periodically monitor and learn an effect of the adjustment of the second offset to the effective static pressure setpoint of the AHU 102 for efficient operation of each of the plurality of VAV units 106. This is done so as to maintain the required effective static pressure setpoint at the AHU 102 so that no VAV unit 106 becomes a starving VAV unit.

Therefore, the starvation problem of the VAV unit 106 is resolved by the present invention, And, automated determination and operation of the AHU 102 at the effective static pressure setpoint at the AHU 102 is achieved by the present invention. By doing this, effort put by the technician on audit time & manual power will be saved. Also, fan operates on or very close to the system effect curve hence, energy is saved on operation of the fan as least impedance path is followed. Accordingly, time of the technician is saved as the static pressure setpoint is set automatically.

The present invention also encompasses monitoring of an existing static pressure control strategy instantaneous value at a defined interval time along with a recorded data to compare it with an impedance curve. Further, the present invention also encompasses equating and showing energy losses to a user due to not following the impedance curve.

Figure 2:
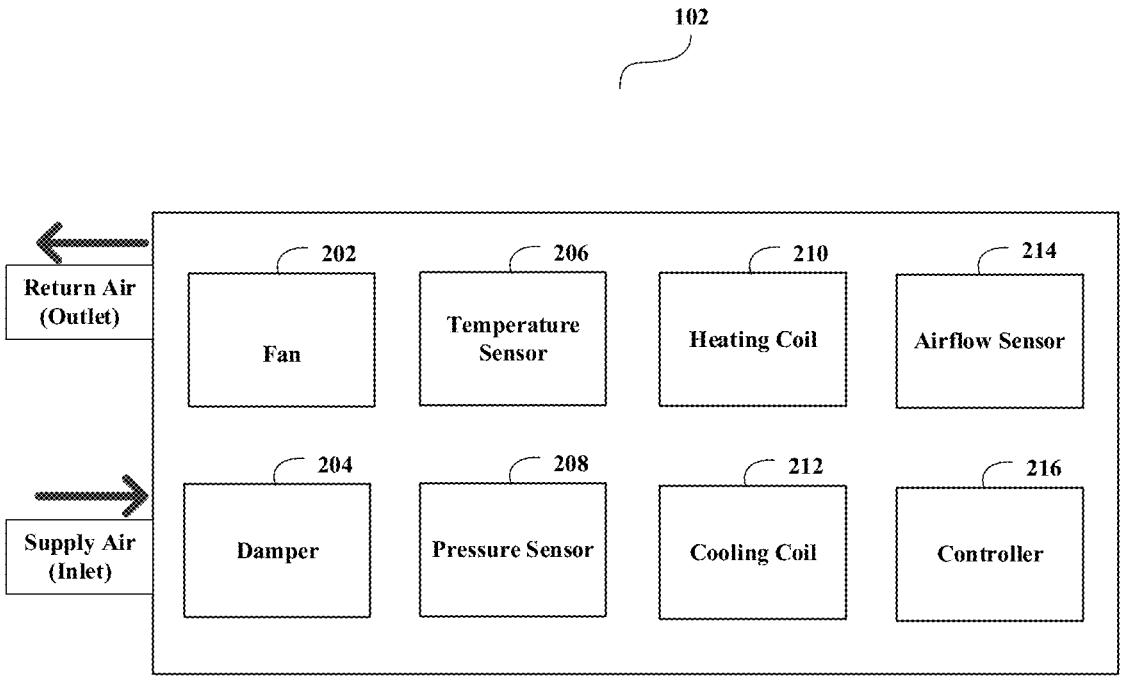
FIG. 2 depicts block diagram of different components of an exemplary air handling unit according to an exemplary embodiment of the invention.

FIG. 2 depicts block diagram of different components of an exemplary air handling unit (AHU) 102 according to an exemplary embodiment of the invention. The AHU 102 may comprise of, but is not limited to, one or more fan/s 202, damper/s 204, temperature sensor/s 206, a pressure sensor 208, heating coil 210, cooling coil 212, an airflow sensor 214 and/or a controller 216. The one or more fan/s 202 may be configured to draw air from the surroundings/environment and may be configured to provide air to the heating coil 210 if heating is to be maintained in zones 110 or to the cooling coil 212 if cooling is to be maintained. The other fan/s of the one or more fan/s 202 may also be configured to draw the air outside from the AHU 102. The AHU may also comprise variable frequency drive (not shown) for modulating speed of the fan 202 and providing RPM value of the fan 202. The damper/s 204 may be configured to select appropriate return air & outside air to provide fresh air to each VAV unit 106 in a building and to use return air to retain the cold air. The temperature sensor/s 206 may be configured to sense temperature of the air in the AHU 102 and may communicate the sensed temperature to the controller 216. Moreover, the controller 216 may also be configured to receive inputs from the pressure sensor 208. The pressure sensor 208 may be installed in the one or more supply ducts 104 and may be wired to the controller 216. Such pressure sensor 208 may be adapted to measure pressure inside the one or more ducts 104 and may provide a value of the measured pressure to the controller 216 for operating the AHU 102 at the effective static pressure setpoint. The airflow sensor 214 may be configured to sense airflow setpoint value in the AHU 102 and may communicate the sensed airflow to the controller 216. The controller 216 may further be configured to receive airflow setpoint values from each VAV unit 106 to determine a combined airflow set point for the VAV units 106 as discussed above in FIG. 1. The controller 216 may further be configured to determine an effective static pressure setpoint for the AHU 102 based on a relation between the combined airflow setpoint value and a static pressure represented by a system effect curve. Accordingly, the controller 216 may also configured to operate the AHU 102 at the effective pressure setpoint as discussed above in details. The controller 216 may also provide command/s to the fan 202, the damper/s 204, the cooling coil 212 and/or the heating coil 210.

Figure 3:
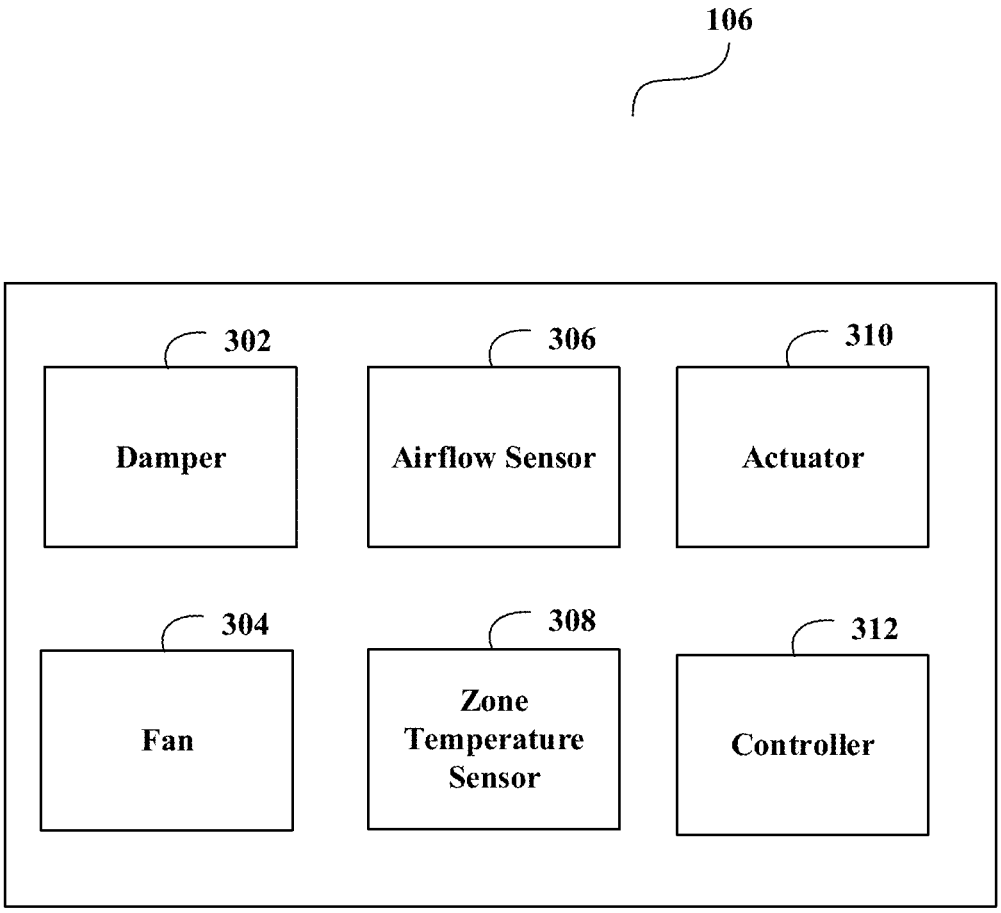
FIG. 3 depicts block diagram of different components of an exemplary variable air volume (VAV) unit according to an exemplary embodiment of the invention.

FIG. 3 depicts block diagram of different components of an exemplary variable volume (VAV) unit 106 according to an exemplary embodiment of the invention. The VAV unit 106 may comprise of, but is not limited to, damper/s 302, fan/s 304, an airflow sensor 306, a zone temperature sensor 308, an actuator 310 and/or a controller 312. The zone temperature sensor 308 may be configured to sense temperature in its respective zone 110. The controller 312 may be configured to provide a command to the actuator 310 for changing or maintaining a position of the damper 302 based on a command from the AHU 102 and the requirement of a desired temperature and to allow the air to pass through it. The controller 312 may further be configured to determine or equate airflow setpoint values of each of the plurality of VAV units 106 based on load requirement, a value of maximum allowed airflow setpoint & a value of minimum allowed airflow setpoint. The airflow sensor 306 may be configured to sense a flow of air in the VAV unit 106. The controller 310 may also be configured to control operations of the VAV unit 106 such as receiving temperature value from the zone temperature sensor 308, controlling temperature in each zone 110 based on cooling temperature setpoint to be achieved. The fan/s 304 may be adapted to provide or draw air from the VAV unit 106.

Figure 4:
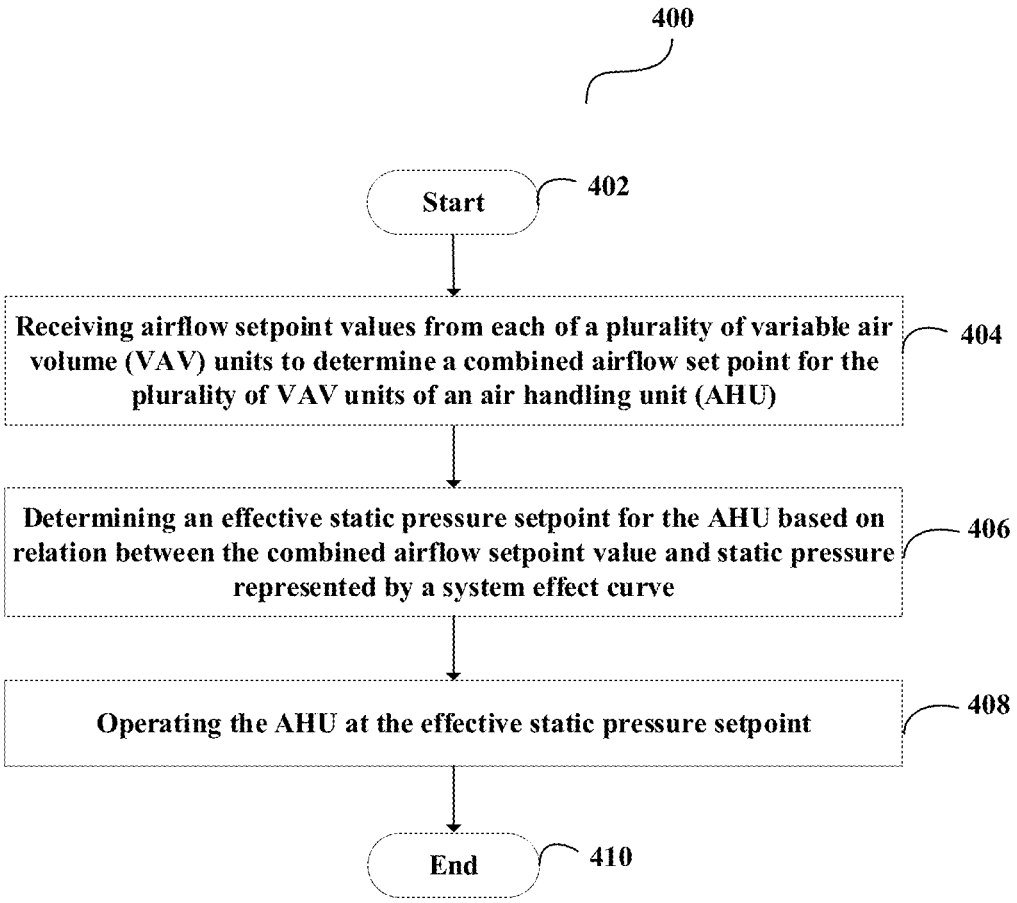
FIG. 4 depicts an exemplary flowchart illustrating a method to perform the invention according to an exemplary embodiment of the invention.

FIG. 4 depicts a flowchart outlining the features of the invention in an exemplary embodiment of the invention. The method flowchart 400 describes a method being for operating an air handling unit (AHU) 102 at an effective static pressure setpoint in a HVAC system. The method flowchart 400 starts at step 402.

At step 404, a controller 216 of the AHU 102 may receive airflow setpoint values from each of a plurality of VAV units 106 to determine a combined airflow set point for the plurality of VAV units 106 of the AHU 102. This has been discussed in greater details in FIG. 1 above.

At step 406, the controller 216 of the AHU 102 may determine an effective static pressure setpoint for the AHU 102 based on a relation between the combined airflow setpoint value and a static pressure represented by a system effect curve. This has been discussed in greater details in FIG. 1 above.

At step 408, the controller 216 of the AHU 102 may operate the AHU 102 at the effective static pressure setpoint. This has been discussed in greater details in FIG. 1 above. Then, the method flowchart 400 may end at 410.

Figure 5:
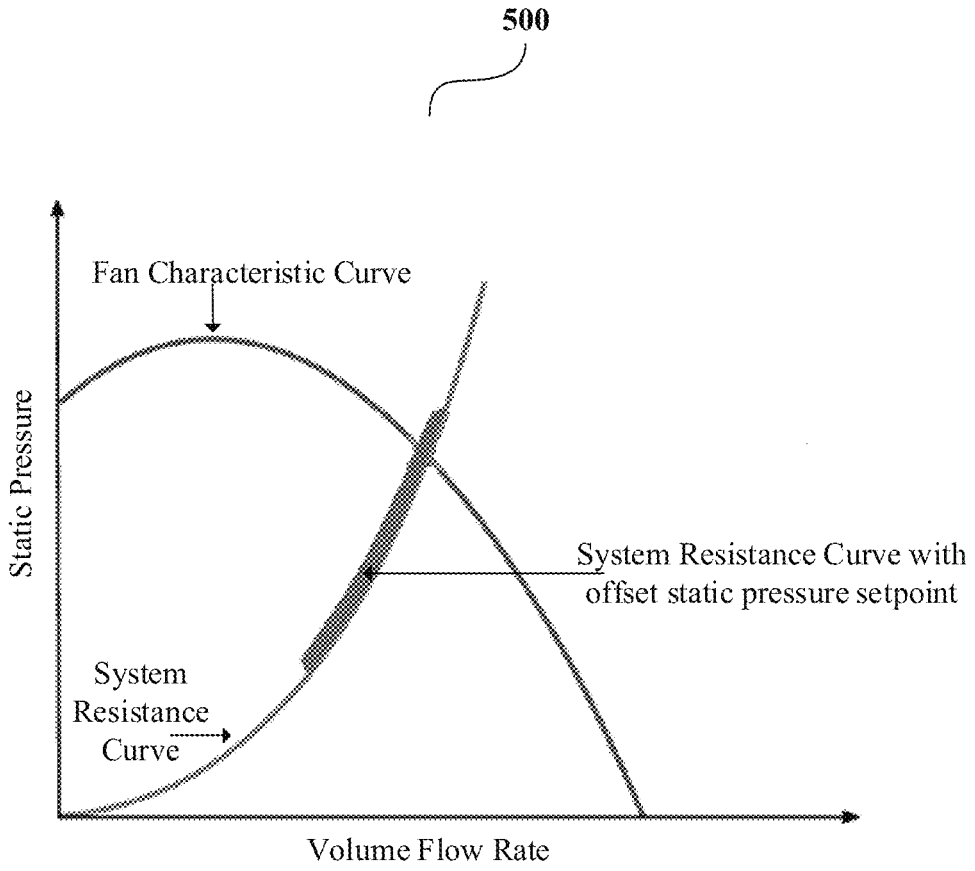
FIG. 5 depicts an exemplary graph showing relation between a fan characteristic curve, a system resistance curve and a system resistance curve with offset static pressure setpoint according to an exemplary embodiment of the invention.

FIG. 5 depicts an exemplary graph 500 showing a relation between a fan characteristic curve, a system resistance curve and a system resistance curve with offset static pressure setpoint according to an exemplary embodiment of the invention. As explained above in FIG. 1, the system resistance curve and the system resistance curve with offset static pressure setpoint are determined and adjusted in order to operate the AHU 102 at the effective static pressure setpoint.

The present invention is applicable in various industries/fields such as, but is not limited to, banking industry, hospitality industry, housing industry, building/construction industry, offices, universities, hospitals, colleges, homes and any such industry/field that is well known in the art and where the HVAC systems are used.

The embodiments of the invention discussed herein are exemplary and various modification and alterations to a person skilled in the art are within the scope of the invention.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "controller" can refer to substantially any processor or computing processing unit or device comprising, but not limited to comprising, a direct digital control of a HVAC system, a zone controller of the HVAC system, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A method comprising:

receiving airflow setpoint values from each of a plurality of variable air volume (VAV) units to determine a combined airflow set point for the plurality of VAV units of an air handling unit (AHU);

determining an effective static pressure setpoint for the AHU based on a relation between the combined airflow setpoint value and a static pressure represented by a system effect curve;

operating the AHU at the effective static pressure setpoint;

monitoring, by the AHU, a damper position of each VAV unit for determining a starving VAV unit from the plurality of VAV units and computing the effective static pressure setpoint of the AHU based on a relation between the combined airflow setpoint value and a static pressure represented by a system effect curve;

determining, by the AHU, an offset for the starving VAV unit; and adjusting, by the AHU, the offset to the effective static pressure setpoint of the AHU for the starving VAV unit.

2. The method of claim 1, wherein the adjustment of the offset to the effective static pressure setpoint of the AHU is achieved by either increasing or decreasing the effective static pressure setpoint of the AHU.

3. The method of claim 1, further comprising, automatically monitoring and learning an effect of the adjustment of the offset to the effective static pressure setpoint of the AHU for efficient operation of each of the plurality of VAV units.

4. The method of claim 1, further comprising, determining a second starving VAV unit and a second offset based on the effect of the adjustment of the offset to the effective static pressure setpoint of the AHU.

5. The method of claim 1, wherein the airflow setpoint values of each of the plurality of VAV units is determined based on load requirement, a value of maximum allowed airflow setpoint and a value of minimum allowed airflow setpoint.

6. The method of claim 1, wherein the effective static pressure setpoint is obtained by varying the speed of a fan to meet the demand of the effective static pressure setpoint.

7. The method of claim 6, wherein the fan operates in accordance with the system effect curve to follow a least impedance airflow path.

8. The method of claim 1, wherein the AHU is connected with each of the VAV units through one or more ducts.

9. The method of claim 1, further comprising, monitoring an existing static pressure control strategy instantaneous value at a defined interval time along with a recorded data to compare it with an impedance curve.

10. A system comprising:

a plurality of variable air volume (VAV) units configured to determine airflow setpoint values and communicate the airflow setpoint values; and an air handling unit (AHU) comprising a controller configured to:

receive the airflow setpoint values from each of the VAV units;

determine a combined airflow set point for the plurality of VAV units of the AHU;

determine an effective static pressure setpoint based on a relation between the combined airflow setpoint value and a static pressure represented by a system effect curve; and operate the AHU at the effective static pressure setpoint;

wherein the controller is further configured to monitor a damper position of each VAV unit for determining a starving VAV unit from the plurality of VAV units and compute the effective static pressure setpoint of the AHU based on a relation between the combined airflow setpoint value and a static pressure represented by a system effect curve;

wherein the controller is further configured to determine an offset for the starving VAV unit; and adjust the offset to the effective static pressure setpoint of the AHU for the starving VAV unit.

11. The system of claim 10, wherein the adjustment of the offset to the effective static pressure setpoint of the AHU is achieved by either increasing or decreasing the effective static pressure setpoint of the AHU.

12. The system of claim 11, wherein the controller is further configured to automatically monitor and learn an effect of the adjustment of the offset to the effective static pressure setpoint of the AHU for efficient operation of each of the plurality of VAV units.

13. The system of claim 10, wherein the controller is further configured to determine a second starving VAV unit and a second offset based on the effect of the adjustment of the offset to the effective static pressure setpoint of the AHU.

14. The system of claim 10, wherein the effective static pressure setpoint is obtained by varying the speed of a fan to meet the demand of the effective static pressure setpoint.

15. The system of claim 14, wherein the fan operates in accordance with the system effect curve to follow a least impedance airflow path.

16. The system of claim 10, wherein the AHU is connected with each of the VAV units through one or more ducts.

17. The system of claim 10, wherein the airflow setpoint values of each of the plurality of VAV units is determined based on load requirement, a value of maximum allowed airflow setpoint and a value of minimum allowed airflow setpoint.

* * * * *